United States Patent [19]

Heck

[11] Patent Number: 4,457,076

[45] Date of Patent: Jul. 3, 1984

[54] BOW SIGHT

[76] Inventor: Albert E. Heck, 1131 Grand Prix, St. Charles, Mo. 63301

[21] Appl. No.: 427,656

[22] Filed: Sep. 29, 1982

[51] Int. Cl.[3] ..... F41G 1/46

[52] U.S. Cl. ..... 33/265

[58] Field of Search ..... 33/265, 256, 257, 258, 33/254, 252

[56] References Cited

U.S. PATENT DOCUMENTS

| | | | |
|---|---|---|---|
| 2,585,933 | 2/1952 | Harey | 33/256 |
| 3,284,904 | 11/1966 | Rade | 33/265 |
| 3,787,984 | 1/1974 | Bear et al. | 33/265 |
| 3,800,424 | 4/1974 | Saunders et al. | 33/265 |
| 3,822,479 | 7/1974 | Kowalski | 33/265 |
| 3,854,217 | 12/1974 | Killian | 33/265 |

*Primary Examiner*—William D. Martin, Jr.

*Attorney, Agent, or Firm*—Polster, Polster & Lucchesi

[57] ABSTRACT

An adjustable sight mechanism for an archery bow has an elongated base, a sight support assembly mounted on the base and a sight assembly mounted on the sight support. The sight support assembly includes a sight carriage block with a turret unit mounted on the block for rotation about the axis of a stub shaft projecting from the turret unit into a passage through the sight carriage block. A slot is provided through the length of the passage, and a set screw is arranged to squeeze the turret shaft. An anchor block that can be locked to the base has a flat face against which a vertical adjustment knob bears. The flat face has in it a series of seats arranged on a circle, and the knob has a spring loaded detent both to inhibit rotation of the knob and to permit a click adjustment. The sight assembly has a sleeve-carrying tube with a flat radial face at one end, which is also provided with seats arranged circularly, and a transverse adjustment knob, threaded on an adjusting rod, is provided with a spring loaded detent, both to inhibit rotation of the knob and to permit a click adjustment. In this way, the sight mechanism provides click adjustment for both elevation and traverse.

7 Claims, 13 Drawing Figures

BOW SIGHT

BACKGROUND OF THE INVENTION

Archery bow sights are well known, and range in complexity from relatively simple ones, attached directly to the bow, exemplified by Saunders et al. U.S. Pat. No. 3,800,424, to relatively complex mechanisms, mounted on T-shaped brackets, as exemplified by patents to Kowalski U.S. Pat. No. 3,822,479 and Killian, Pat. No. 3,854,217. The present invention is directed to an adjustable bow sight mechanism that combines simplicity and ruggedness with the capacity for fine adjustment in both elevation and traverse, and for angularity of the sight with respect to the bow.

One of the objects of this invention is to provide an adjustable bow sight mechanism which provides for click adjustment in both elevation and traverse.

Another object is to provide such a bow with simple provision for adjustment of angularity of the sight with respect to the bow.

Other objects will become apparent to those skilled in the art in the light of the following description and accompanying drawing.

SUMMARY OF THE INVENTION

In accordance with this invention, generally stated, an adjustable bow sight mechanism is provided which includes an elongated base, a sight support assembly slidably mounted on the base for travel lengthwise of the base, and a sight assembly. The sight support assembly includes a sight carriage block with a turret unit with a stub shaft rotatably mounted in the sight carriage block in a slotted passage that can be constricted to squeeze the shaft. By relaxing the clamping of the stub shaft, the turret, hence the sight carried by the turret, can be rotated to any practical desired angularity with respect to the bow, and the clamping restored to hold it in that position. It also includes an anchor block with means for locking the block in place on the base, a threaded vertical (elevation) adjustment rod extending through the anchor block, an adjustment knob threaded on an outer end of the adjustment rod, and a compression spring between the anchor block and the sight carriage block. The vertical adjustment knob and the facing surface of the anchor block are provided with complementary elements of spring loaded detent means, whereby turning of the knob when the anchor block is locked and the sight carriage block is not, provides a click adjustment of the sight carriage block in elevation. The sight assembly is removably mounted in the turret unit. It includes a sight sleeve carrying tube with a noncircular socket, a sight sleeve having a noncircular outside configuration complementary to the noncircular socket, a threaded sight stem mounted in the sleeve with an end projecting from the sleeve and through an end of the tube, and a sight adjustment knob threaded on the outer end of the stem. Facing surfaces of the knob and tube are provided with complementary elements of spring loaded detent means, whereby turning of the knob provides a click adjustment of the sight in traverse.

DESCRIPTION OF THE PREFERRED EMBODIMENT

Figure 1:
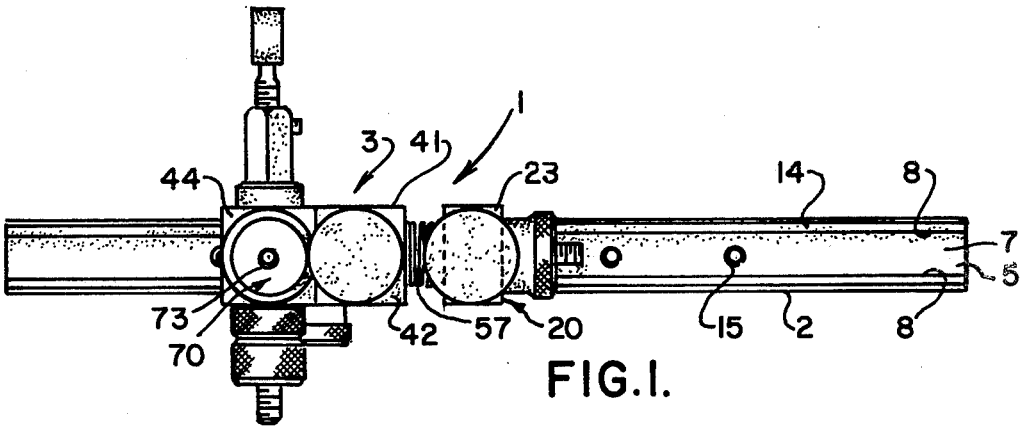
FIG. 1 is a top plan view of one illustrative embodiment of bow sight mechanism of this invention.
Figure 2:
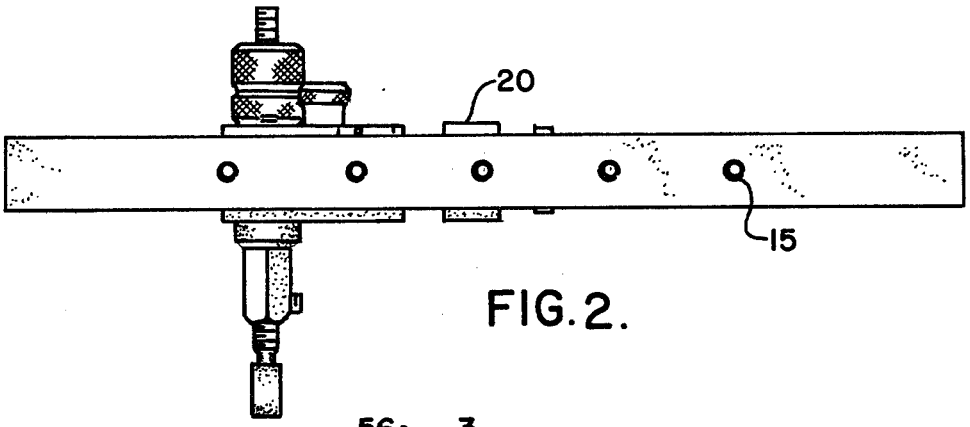
FIG. 2 is a bottom plan view.

Referring now to the drawing, reference numeral 1 indicates a complete bow sight mechanism of this invention. The mechanism of this illustrative embodiment includes a base 2, a sight support assembly 3 and a sight assembly 4.

The base has a bottom wall 5 and side walls 6, defining, with inboardly directed overhanging ledges 8, a channel 7. The inner upper surfaces of the side walls 6 are machined to slope divergently upwardly to form chamfered slide surfaces 14. Mounting holes 15 extend through the bottom wall 5.

Figure 6:
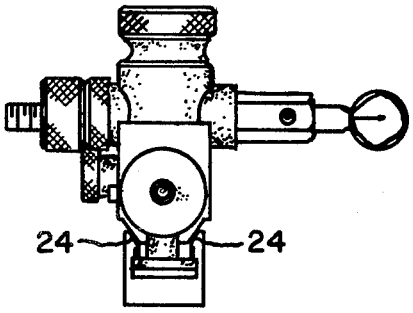
FIG. 6 is a view in end elevation viewed from right to left of FIG. 1.
Figure 7:
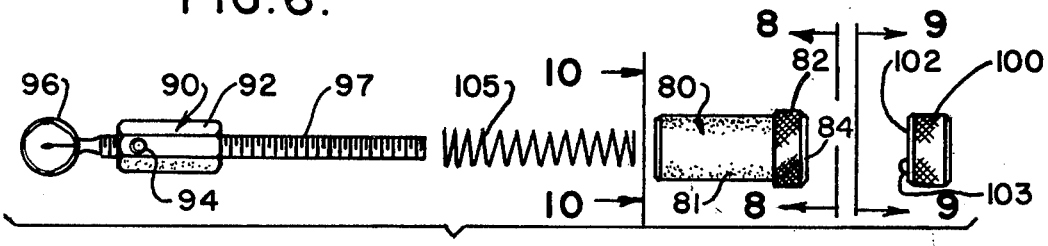
FIG. 7 is an exploded view of the sight assembly of this embodiment.
Figure 8:
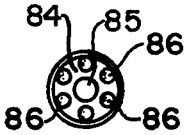
FIG. 8 is a view in end elevation taken along the line 8—8 of FIG. 7.
Figure 9:
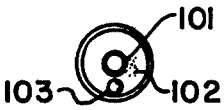
FIG. 9 is a view in end elevation taken along the line 9—9 of FIG. 7.
Figure 10:
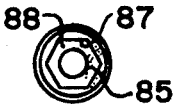
FIG. 10 is a view in end elevation taken along the line 10—10 of FIG. 7.
Figure 11:
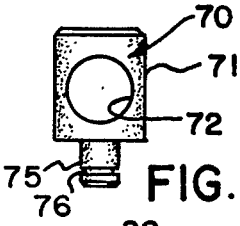
FIG. 11 is a view in side elevation of a turret unit.
Figure 13:
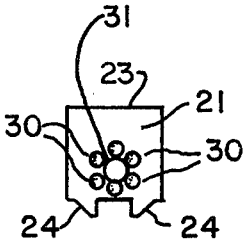
FIG. 13 is a view in end elevation taken along the line 13—13 of FIG. 12. DE
Figure 12:
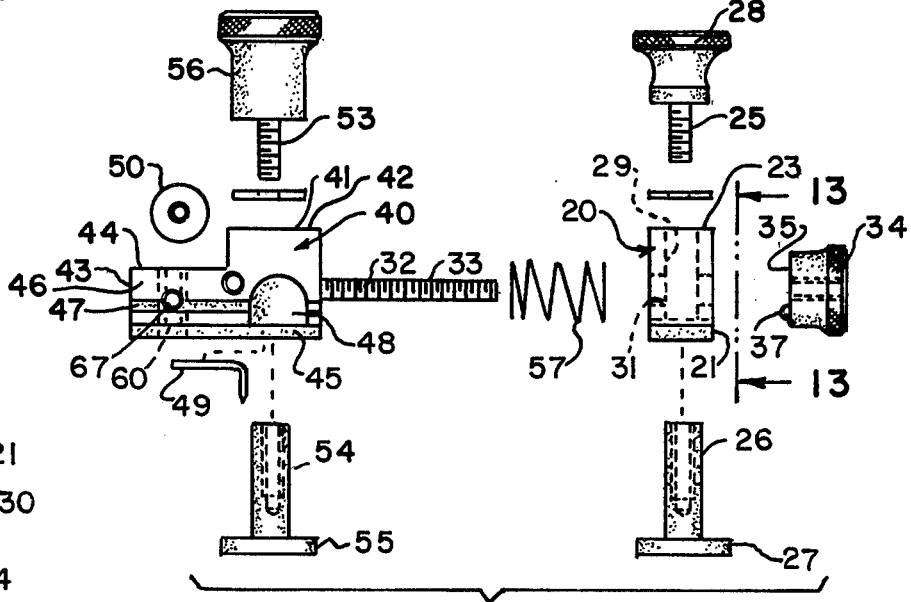
FIG. 12 is an exploded view in side elevation of the sight support assembly.

The sight support assembly 3 includes an anchor block 20 and a sight carriage block 40. The anchor block 20 has an outboard flat side 21 transverse of the long direction of the base and an inboard flat side 22, also transverse of the base, a flat top surface 23 and chamfered anchor block shoes 24, extending from a position inboard of and below the upper edges of the slide 14 to a position outboard and above the slide surfaces. The anchor block is drilled perpendicularly to the flat surface 23 to provide a locking rod passage 29 slidably to receive an internally threaded tube 26 carrying a locking foot 27 at its lower end. A set knob 28 carries a threaded locking rod 25, which is threaded into the tube 26, whereby the locking foot 27 can be pulled up into engagement with the ledges 8, when the locking rod is tightened into the tube 26, as shown particularly in FIG. 6. In the embodiment shown, in which the knob and anchor block are made of hard aluminum, a brass washer is interposed between the knob 28 the surface 23 to prevent seizing. In this embodiment, seats 30, best shown in FIG. 13, are provided in the flat side 21, arranged in a circle around an adjusting rod passage 31 extending through the block 20 in a direction parallel to the long axis of the slide 14.

An elevation adjusting rod 32, with a threaded end 33, is mounted at one end in the sight carriage block 40. It extends freely through the passage 31, and through a slot or enlarged hole extending diametrically through the tube 26 intermediate the ends of the tube, and has threaded on its end 33 an elevation adjusting knob 34. The knob 34 has a flat radial face 35 facing the flat side 21 and a spring loaded detent ball 37 mounted in the knob and projecting from the face 35 on the same radius as the seats 30, in which the detent ball seats.

Figure 3:
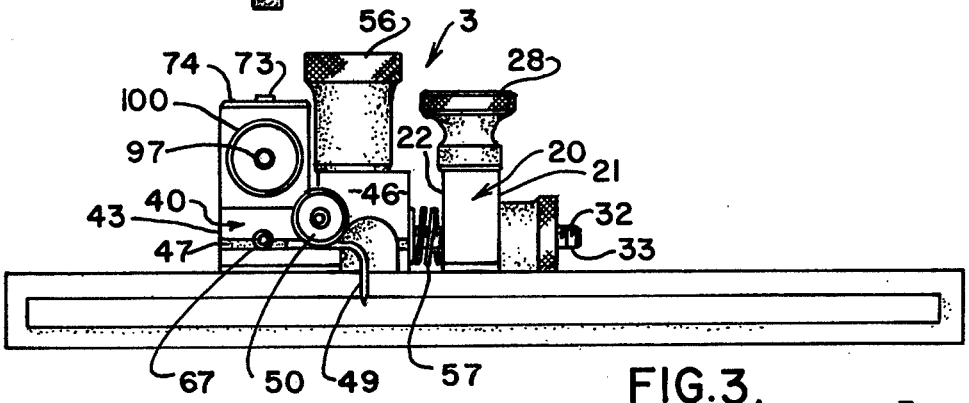
FIG. 3 is a view in side elevation from bottom to top of FIG 1.

The sight carriage block 40 includes a locking section 41 with a flat top 42 and a turret mounting section 43 with a flat top 44. Tapered shoes 45, extending the length of the block 40, are identical with the tapered shoes 24 of the anchor block. The block 40 has flat sides 46 in one of which is a groove 47 extending lengthwise of the block, parallel to the shoe 45, and opening into a recess 48. An L-shaped indicator 49 is held in the groove 47 and recess by an indicator clamping nut 50, as shown in FIG. 3.

The locking section of the carriage block has a passage perpendicular to the surface 42 through which a locking section locking rod 53 extends and is threaded into a tube 54 carrying a foot 55. The rod 53 is carried by a knob 56. The construction and operation of the locking section locking mechanism just described are substantially the same, except for the shape and dimensions of the knob 56, as the locking assembly of the anchor block described above.

A helical compression spring 57, mounted around the elevation adjusting rod 32 between the anchor block and the sight carriage block, butts against facing surfaces of the two blocks, and biases the two blocks in a direction away from one another.

A turret section stub shaft receiving passage 60 extends perpendicularly to the top surface 44 through the turret mounting section 43. A slot 61 extends through the flat side 46 opposite the side in which the groove 47 is, and through the wall defining the passage 60. A passage 62 extends parallel to the long direction of the block from the outboard face of the block to the slot 61, and an aligned internally threaded hole 63 extends into the block from the slot 61. The passage 62 is sized freely to receive a threaded lock screw 64, which is threadedly received in the hole 3. The function of the lock screw 64 is to distort the block slightly to constrict the passage 60. An internally threaded hole extends from the side 46 in which the groove 47 is, meeting the passage 60 radially, and a turret set screw 67 is threadedly mounted in it.

A turret unit 70 has a cylindrical body 71 through which a sight tube passage 72 extends diametrically. The body has a flat top surface 74 through which a set screw passage extends to meet the passage 72 radially, and which threadedly receives a set screw 73. The turret unit has a stub shaft 75, projecting from the bottom of the body and concentric with it. The shaft 75 has an annular groove 76 in it, to receive set screw 67. The stub shaft 75 is mounted in the turret section passage 60 closely but rotatably when the lock screw 64 is backed off, but tightly when the lock screw 64 is tightened.

The sight assembly 4 includes a sight sleeve carrying tube 80 with a cylindrical outer section 81 at one end of which is a collar section 82. The collar section has a flat radial end face 84 with a central hole 85 through it. In this embodiment, detent seats 86 are arranged concentrically about the central hole 85 in the face 84. The tube 80 has a inner wall defining a hexagonal socket section through the length of the cylindrical outer section. The inner wall ends short of the end of the tube, forming with the collar section an inner shoulder 88 around the central hole 85.

A sight sleeve 90 has a hexagonal outer surface 92 through one face of which a set screw passage extends to receive a threaded set screw 94. The set screw passage opens radially into a threaded passage extending longitudinally through the sleeve from one end to the other.

A sight 96 has a threaded sight shank 97 on one end of which is a sight ring 98. The threaded shank 97 in this embodiment is threaded into the internally threaded passage extending longitudinally through the sleeve. On the opposite end of the shank 97 from the sight ring 98, a sight traverse adjusting knob 100, with a central internally threaded passage 101 is threadedly mounted. The knob 100 has a radial flat face 102 facing the flat face 84 of the tube 80. A spring loaded detent ball 103 is mounted to project from the flat face 102. The ball, which is biased outwardly, is on the same radius as the seats 86, which receive the ball. A spring 105 is mounted around the shank 97 and bears at one end on a radial end face of the sight sleeve 90 and at its other, on the annular inner shoulder 88 of the tube 80, biasing the sleeve 90 away from the tube 80. The sleeve 90 fits closely but slidably within the sight tube 80.

Figure 4:
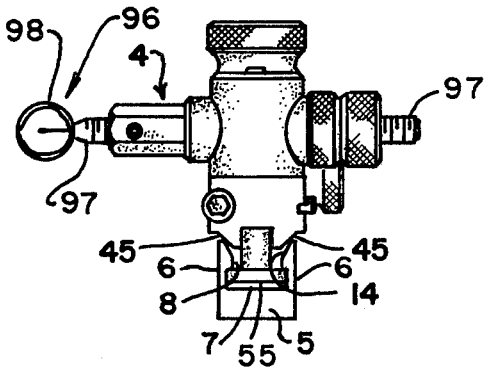
FIG. 4 is a view in end elevation, viewed from left to right of FIG. 3.
Figure 5:
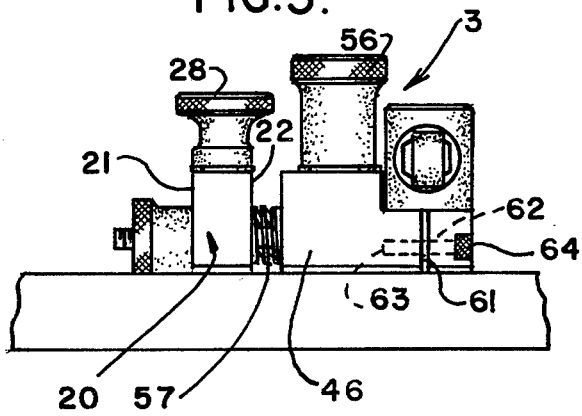
FIG. 5 is a fragmentary view in side elevation viewed from top to bottom of FIG. 1.

The assembly of the mechanism will be self-evident from the description and drawing. The tubes 26 and 54 and the feet 27 and 55 which are integral with the tubes, are preferably made of brass. The sight sleeve 90 is threaded onto the shank 97, and the set screw 94 inserted and tightened to hold the shank, hence the sight ring 98, in a desired position relative to one another. The spring 105 is mounted around the shank 97, and seated in the tube 80, the free end of the shank 97 extends through the hole 85, and the adjusting knob 100 is threaded onto the shank 97. The sight assembly is mounted in the turret unit by sliding the tube into the passage 72, with the sight oriented in either direction desired, and the set screw 73 is tightened against the outer surface of the tube to hold it securely. Rotating the knob 100 in a clockwise direction as viewed in FIG. 3 moves the sleeve 90 against the bias of the spring 105 to the right as viewed in FIG. 4, and rotating it counterclockwise, permits the spring to move the sleeve to the left. When the desired amount of traverse has been provided, fine adjustment can be made by feel, because of the engagement of the detent ball 103 and the sockets 86.

The provision of the split block and central stub shaft on the turret permits the angularity of the sight with respect to the slide, hence with respect to the bow itself, to be adjusted through several degrees each way from the perpendicular, or to be restored to the perpendicular with respect to the bow. By taking into the angular slot 76, the set screw 67 holds the turret against displacement upwardly when the lock screw 64 is loosened, but permits rotation.

A ring sight has been shown. Other types of sight can be mounted either on a threaded shank or directly on the sleeve. In the latter case, the threaded shank can be secured to the sleeve in the area of the hole 85. The advantage of the arrangement shown and described is that the sight can be pre-positioned with respect to the sleeve and clamped in that position, before fine adjustment of the traverse by the use of the adjusting knob 100. The hexagonal form of the sleeve and tube socket is a convenient form, but other polygonal or otherwise non-circular forms can be used.

It can be seen that the seats 30 can be put in the face 35 of the knob 34, and the detent 37, in the side 21 in the sight support assembly, and similarly the seats 86 can be put in the face 102, and the detent 103 in the face 84 in the sight assembly. Other forms of click detent can be employed, such, for example, as a radial rib on one surface, and a series of radial grooves on the other, although the spring loaded ball and hemispherical seat arrangement is a simple and effective system. Other materials besides aluminum for the base and blocks, brass for the washers, tubes and feet and steel for the threaded rods and shanks can be used. These variations are merely illustrative.

I claim:

1. An adjustable bow sight mechanism comprising an elongated base, a sight support assembly slidably mounted on said base for travel longitudinally of the base, said sight support assembly comprising a sight carriage block, a turret unit rotatably mounted on said sight carriage block and a sight assembly mounted on said turret unit, an anchor block having a flat surface on a side away from the sight carriage block, biasing means exerting constant bias against the anchor block and sight carriage block, a threaded elevation adjustment rod mounted in said sight carriage block and extending through said anchor block, an elevation adjustment knob with a radial flat surface adjacent the flat surface of the anchor block threaded on said elevation adjustment rod, said anchor block and elevation adjustment knob having click adjustment means in said flat surfaces.

2. The adjustable bow sight mechanism of claim 1 wherein the click adjustment means comprises a spring loaded detent in one of said flat surfaces and spaced seats in the other of said flat surfaces positioned equispacedly on a circle to receive said detent.

3. The sight mechanism of claim 1 wherein said sight assembly comprises a sight sleeve carrying tube with a socket, non-circular in cross-section open at one end and restricted at another end to define an annular shoulder about a through passage, a sight sleeve having a non-circular outside configuration complementary to the non-circular socket, slidably mounted in said tube, a threaded sight shank mounted in said sleeve and having an end projecting from said sleeve, through said tube passage and therebeyond, a spring mounted in said tube and biasing said tube and sleeve in a direction away from one another, a sight traverse adjusting knob threaded on the projecting end of the shank, said tube and knob having facing flat radial surfaces and click adjustment means on said surfaces whereby said knob can be rotated in discrete increments.

4. The sight mechanism of claim 3 wherin the click adjustment means comprises a spring loaded detent in one of said flat surfaces and spaced seats in the other of said flat surfaces positioned equispacedly on a circle to receive said detent.

5. The sight mechanism of claim 1 wherein said turret unit has a cylindrical passage through it to receive said sight assembly, an elongated stub shaft, circular in end view, projecting with its long axis at right angles to the long axis of said cylindrical passage and aligned diametrically therewith, a turret stub shaft passage in said sight carriage block perpendicular to the line of travel of said sight support assembly, and means for selectively inhibiting and permitting rotation of said turret unit about the axis of said stub shaft.

6. The mechanism of claim 6 wherein a slot is provided extending through the side wall of said turret pin passage through the entire length of said passage and through one outside surface of said sight carriage block, and a set screw is mounted with a head at an exposed end surface of said sight carriage block and a shank, threaded at one end, extending through a passage in said block between said exposed end surface and said slot, across said slot, and into an internally threaded passage in the block on the other side of said slot, whereby tightening of said set screw causes said slot to narrow to constrict the wall of the stub shaft passage to grip said stub shaft.

7. The mechanism of claim 6 wherein the stub shaft has an annular groove in it, and the mechanism includes a lock screw threaded into said sight carriage block on the side opposite said slot and positioned to extend into the said annular groove in the said turret stub shaft when said lock screw is screwed down.

* * * * *